US009670732B1

(12) United States Patent
Bergeron

(10) Patent No.: US 9,670,732 B1
(45) Date of Patent: Jun. 6, 2017

(54) BATCH DRILLING USING MULTIPLE MUDLINE CLOSURE DEVICES

(71) Applicant: Chevron U.S.A. Inc., San Ramon, CA (US)

(72) Inventor: Henry Anthony Bergeron, Houston, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 14/995,321

(22) Filed: Jan. 14, 2016

(51) Int. Cl.

| | |
|---|---|
| ***E21B 7/12*** | (2006.01) |
| ***E21B 33/035*** | (2006.01) |
| ***E21B 33/064*** | (2006.01) |
| ***E21B 43/10*** | (2006.01) |
| *E21B 33/14* | (2006.01) |

(52) U.S. Cl.
CPC ..... *E21B 7/12* (2013.01); *E21B 33/035* (2013.01); *E21B 43/101* (2013.01); *E21B 33/143* (2013.01)

(58) Field of Classification Search
CPC ..... E21B 7/12; E21B 7/128; E21B 33/035; E21B 33/064; E21B 33/143; E21B 41/0007; E21B 43/101
See application file for complete search history.

(56) References Cited

U.S. PATENT DOCUMENTS 4,163,477 A * 8/1979 Johnson ..... E21B 29/08 137/263
5,458,199 A * 10/1995 Collins ..... E21B 7/043 166/313
5,560,435 A * 10/1996 Sharp ..... E21B 7/043 166/313
7,921,917 B2 * 4/2011 Kotrla ..... E21B 33/035 166/339
8,342,249 B2 * 1/2013 Payne ..... E21B 7/12 166/351
8,622,139 B2 * 1/2014 Herbel ..... E21B 29/08 137/315.02
9,033,051 B1 * 5/2015 Lugo ..... E21B 33/064 166/338
9,187,973 B2 * 11/2015 Cain ..... E21B 33/038
9,200,493 B1 * 12/2015 Lugo ..... E21B 29/12
9,238,943 B2 * 1/2016 Jordan ..... E21B 7/12
9,255,446 B2 * 2/2016 Shafer ..... E21B 33/064
9,341,024 B2 * 5/2016 Labrugere ..... E21B 15/003
9,341,025 B2 * 5/2016 Labrugere ..... E21B 15/003
9,347,270 B2 * 5/2016 Shafer ..... E21B 33/064
9,404,333 B2 * 8/2016 Patel ..... E21B 33/124
2015/0021038 A1 * 1/2015 Shafer ..... E21B 33/064 166/363

* cited by examiner

*Primary Examiner* — Matthew R Buck
(74) *Attorney, Agent, or Firm* — King & Spalding LLP

(57) ABSTRACT

A method of offshore batch drilling includes attaching a first MCD to a high pressure wellhead of a first subsea well and attaching a second MCD to a high pressure wellhead of a second subsea well. The method further includes drilling a section of the first subsea well to below a surface casing of the first subsea well through the first MCD. The method also includes drilling a section of the second subsea well to below a surface casing of the second subsea well through the second MCD. Drilling the section of the first subsea well and drilling the section of the second subsea well are performed from an offshore structure.

20 Claims, 8 Drawing Sheets

BATCH DRILLING USING MULTIPLE MUDLINE CLOSURE DEVICES

TECHNICAL FIELD

The present application is generally related to deepwater offshore batch drilling on subsea templates, and in particular to batch drilling involving use of multiple mudline closure devices (MCDs).

BACKGROUND

In deepwater offshore drilling operations using subsea BOPs, multiple wells may be drilled in series or in a batch mode. To illustrate, a subsea template may contain multiple wells. In some series drilling operations, a typical drilling process is to drill a complete well where a respective casing is set after drilling each section of the well. For example, after a first section of the well is drilled to a target depth, the section is set with a structural casing. A second section of the well is then drilled and set with a conductor casing. Another section of the well is then drilled and set with a surface casing. A high pressure wellhead is generally attached to the surface casing prior to running this casing string. A subsea blowout preventer (BOP) is then attached to the high pressure wellhead before proceeding with further drilling below the surface casing. After the subsea BOP is installed, one or more intermediate casings are then set in respective one or more sections of the well that are drilled in series below the surface casing. The production casing is then set in a respective section of the well that is drilled below the lowest of the one or more intermediate casings. Drilling of another well is then started where the drilling of the well and setting of the casings of the second well are performed in the same manner as in the first well.

In some other offshore drilling operations, some of the well sections of multiple wells are drilled and the respective casings are set in a batch operation. To illustrate, structural casings of multiple wells may be set after drilling respective sections of the multiple wells. Conductor casings of the multiple wells may then be set after drilling respective sections of the wells below the respective structural casings. The surface casings of the multiple wells may then be set after drilling respective sections of the wells below the respective conductor casings. Once the surface casings are set with its attached high pressure wellhead, further drilling below the respective surface casings requires installation of a subsea BOP on each well surface casing. However, due to the high cost of subsea BOPs, complexity of installing a subsea BOP, and the costs and risks associated with moving a subsea BOP from one well to another, further drilling below the surface casings of the wells are performed in series. To illustrate, sections of one of the multiple wells below the surface casing of one well are drilled and set with respective one or more intermediate casings and a production casing before drilling sections of another one of the wells below its surface casing. In general, after the intermediate and production casings of a first well are set, the subsea BOP that is attached to the surface casing of the first well is moved and attached to the surface casing of another well before drilling of the sections of the second well below the surface casing of the second well.

Because of differences in the drilling process, material, and equipment used in drilling of different sections of a well, drilling corresponding sections of two or more wells for intermediate and production casings before drilling further sections of the wells may result in reduction of drilling costs.

Thus, a method and system of batch drilling that allows drilling and casing of corresponding sections of multiple wells may result in significant time and cost savings.

SUMMARY

The present application is generally related to deepwater offshore batch drilling on subsea templates, and in particular to batch drilling involving use of multiple MCDs. In an example embodiment, a method of deepwater offshore batch drilling includes attaching a first MCD to a high pressure wellhead of a first subsea well and attaching a second MCD to a high pressure wellhead of a second subsea well. The method further includes drilling a section of the first subsea well to below a surface casing of the first subsea well through the first MCD. The method also includes drilling a section of the second subsea well to below a surface casing of the second subsea well through the second MCD. Drilling the section of the first subsea well and drilling the section of the second subsea well are performed from an offshore structure.

In another example embodiment, a method of offshore batch drilling includes attaching a first MCD to a high pressure wellhead attached to a surface casing of a first subsea well. The method further includes attaching a second MCD to a high pressure wellhead attached to a surface casing of a second subsea well. The method also includes drilling a section of the first subsea well to below the surface casing of the first subsea well through the first MCD. The method further includes drilling a section of the second subsea well to below the surface casing of the second subsea well through the second MCD. Drilling the section of the first subsea well and drilling the section of the second subsea well are performed from an offshore structure.

In yet another example embodiment, an offshore batch drilling system includes an offshore structure, a first MCD attached to a first high pressure wellhead of a first subsea well, and a second MCD attached to a second high pressure wellhead of a second subsea well. The first subsea well and the second subsea well are drilled from the offshore structure. A section of the first subsea well that reaches below a surface casing of the first subsea well is drilled through the first MCD. A section of the second subsea well that reaches below a surface casing of the second subsea well is drilled through the second MCD.

These and other aspects, objects, features, and embodiments will be apparent from the following description and the appended claims.

BRIEF DESCRIPTION OF THE DRAWINGS

Reference will now be made to the accompanying drawings, which are not necessarily drawn to scale, and wherein.

Figure 1:
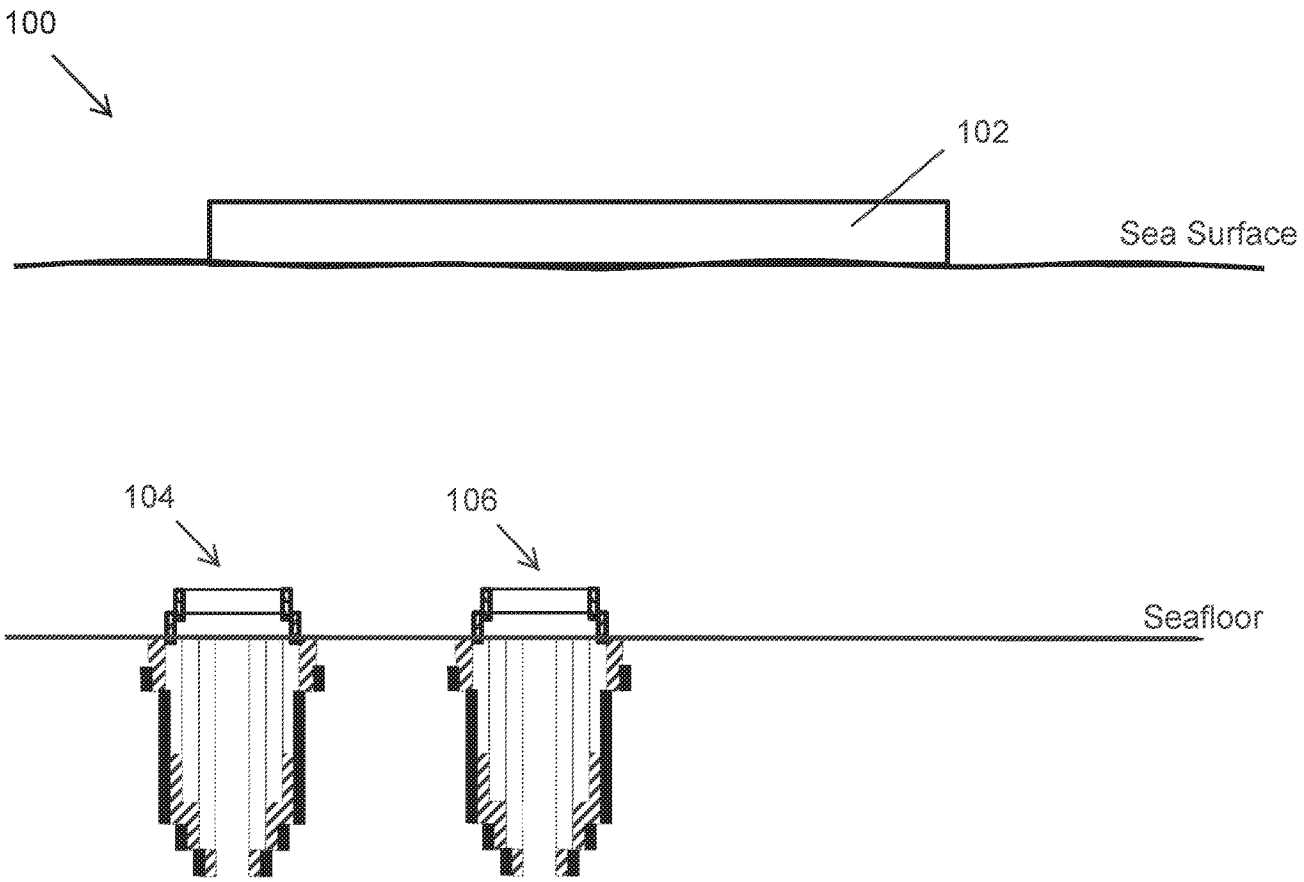
FIG. 1 illustrates an offshore batch drilling system including mudline closure devices (MCDs) according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, reference numerals designate like or corresponding, but not necessarily identical, elements.

DETAILED DESCRIPTION OF THE EXAMPLE EMBODIMENTS

In some example embodiments, the systems and methods of the present application include batch drilling systems and operations involving two or more subsea wells. In general, batch drilling includes drilling multiple wells from a single structure, such as an offshore platform (e.g., a floating drilling rig). Typically, in a subsea well, the structural casing is the first casing string that is set below the mudline. Conductor casing is generally the second string of casing set below the mudline. There may be more than one conductor casings. A reference to a conductor casing may mean more than one conductor casing. Surface casing is the string of casing(s) to which the high pressure wellhead is attached. Intermediate casings are the next strings of casing set below the surface casing and are run through the high pressure wellhead. Production casing is the deepest string of casing and run across the productive interval that is targeted for production and/or injection.

To illustrate, in some example embodiments, after all or at least two of the structural sections are drilled and structural casings set, all or at least two of the conductor sections are drilled and conductor casings are set. Then, all or at least two surface sections are drilled and surface casings are set. A respective high pressure wellhead is attached prior to setting the surface casing. After the two or more MCDs are attached to two or more surface casings, each with its high pressure wellhead, two or more intermediate sections of two or more of the subsea wells are drilled and intermediate casings are set. Then, if applicable, two or more of lower intermediate sections are drilled and respective intermediate casings set. Two or more production sections are then drilled and respective production casings set. In some example embodiments, one or more MCDs may be moved from one or more respective high pressure wellheads and attached to another one or more respective high pressure wellheads during the drilling of one or more intermediate sections or of one or more production sections and/or casing of one or more production sections is being performed on a different subset of subsea wells. For example, one MCD could be moved from a first subsea well to a third subsea well while drilling of a second subsea well is being performed through a second MCD that is attached to the surface casing of the second subsea well.

In the following paragraphs, particular embodiments will be described in further detail by way of example with reference to the drawings. In the description, well-known components, methods, and/or processing techniques are omitted or briefly described. Furthermore, reference to various feature(s) of the embodiments is not to suggest that all embodiments must include the referenced feature(s).

Turning to the drawings, FIG. 1 illustrates an offshore batch drilling system 100 including mudline closure devices (MCDs) according to an example embodiment. The offshore batch drilling system 100 includes an offshore drilling structure 102. For example, the offshore drilling structure 102 may be a semi-submersible structure that is used in the drilling and completion of subsea wells. To illustrate, the offshore drilling structure 102 may be used to drill a subsea well 104 and a subsea well 106.

Figure 2:
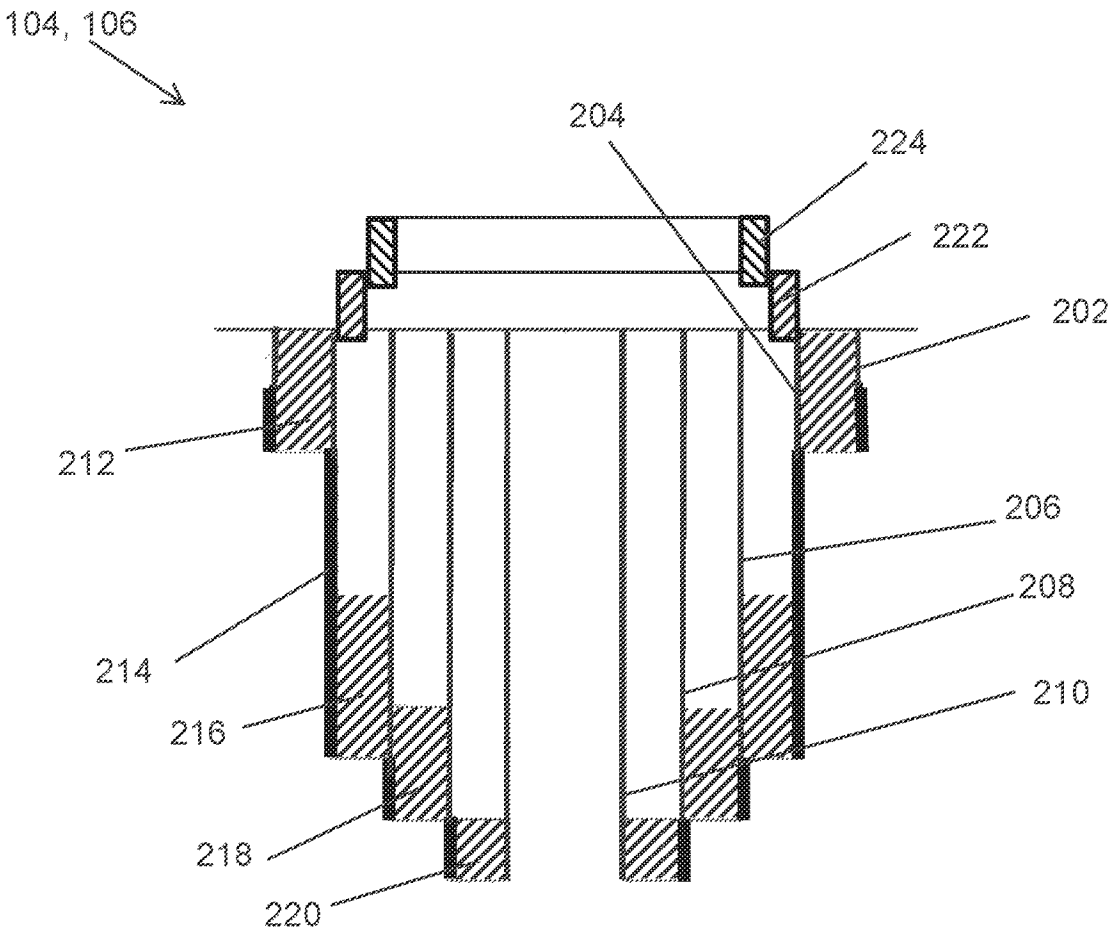
FIG. 2 illustrates a detailed view of the subsea wells of FIG. 1 according to an example embodiment.

FIG. 2 illustrates a detailed view of the subsea wells 104, 106 of FIG. 1 according to an example embodiment. Referring to FIGS. 1 and 2, after all sections of the subsea wells 104, 106 are drilled and respective casings are set, the subsea wells 104, 106 may each include the casings illustrated in FIG. 2. In some example embodiments, each subsea well 104, 106 includes a conductor casing 202 and a surface casing 204. For example, a section of each subsea well 104, 106 may be drilled and cased with the conductor casing 202. In some example embodiments, a structural casing (not shown) may be set in a respective section of each subsea well 104, 106 before drilling the sections of the subsea wells 104, 106 that are set with the conductor casing 202.

The section of each subsea well 104, 106 that is set with the conductor casing 202 may be drilled up to a target depth for receiving the conductor casing 202. The section of each subsea well 104, 106 corresponding to the conductor casing 202 is drilled from the offshore drilling structure 102. For example, the section of the subsea well 104 that is set with the conductor casing 202 may be drilled first from the offshore drilling structure 102 followed by drilling, from the offshore drilling structure 102, the section of the subsea well 106 that is set with the conductor casing 202.

The mud used in drilling the section of the subsea well 104 that is set with the conductor casing 202 may be used to drill the corresponding section of the subsea well 106 that is set with the conductor casing 202. To illustrate, the section of the subsea well 104 that is set with the conductor casing 202 may be drilled and set with the conductor casing 202 before drilling and casing the corresponding section of the subsea well 106 that is set with the conductor casing 202, which may be drilled before further lower sections of the subsea well 104 are drilled. The conductor casing 202 of each subsea well 104, 106 is cemented before drilling lower sections of the subsea wells 104, 106.

After setting the conductor casing 202 in the corresponding section of each subsea well 104, 106 as described above, a lower section of each subsea well 104, 106 is drilled and set with a surface casing 204. The lower section of each subsea well 104, 106 that is set with the surface casing 204 may be drilled up to a target depth for receiving the surface casing 204. The surface casing 204 of each subsea well 104, 106 extend down from the seafloor through the conductor casing 202.

The section of each subsea well 104, 106 corresponding to the surface casing 204 is drilled from the offshore drilling structure 102. For example, the section of the subsea well 104 that is set with the surface casing 204 may be drilled first from the offshore drilling structure 102 followed by drilling, from the offshore drilling structure 102, of the section of the subsea well 106 that is then set with the surface casing 204.

The mud used in drilling the section of the subsea well 104 that is set with the surface casing 204 may be used to drill the corresponding section of the subsea well 106 that is set with the surface casing 204. To illustrate, the section of the subsea well 104 that is set with the surface casing 204 may be drilled and set with the surface casing 204 before drilling and casing the corresponding section of the subsea well 106 that is set with the surface casing 204, which may be drilled before further lower sections of the subsea well 104 are drilled. The surface casing 204 of each subsea well 104, 106 is cemented before drilling lower sections of the subsea wells 104, 106. For example, cement 212 may be formed around the surface casing 204 of each subsea well 104, 106 by pumping down cement from the offshore drilling structure 102 or from another offshore structure known to those of ordinary skill in the art. For example, the offshore drilling structure 102 may be a floating drilling rig.

After setting the surface casing 204 in the corresponding section of each subsea well 104, 106 as described above, a respective high pressure wellhead 222 may be attached to the surface casing 204 of each subsea well 104, 106 prior to drilling lower sections of the wells 104, 106. In some alternative embodiments, the high pressure wellhead 222 may be attached to a casing other than the surface casing 204.

After the respective high pressure wellhead 222 is attached to the surface casing 204 of each subsea well 104, 106, an MCD 224 may be attached to the high pressure wellhead 222 of each subsea well 104, 106. For example, the MCD 224 could be run on a drill pipe (or some other pipe-based running string) after cementing the surface casings. The MCD 224 can also be run using a wire from a drill rig or other vessel. The MCD 224 can also be attached to a drilling riser. Alternatively, the MCD 224 may be attached to the high pressure wellhead 222 at the offshore drilling structure 102 before running the high pressure wellhead 222 along with the MCD 224 to the seafloor.

Figure 3:
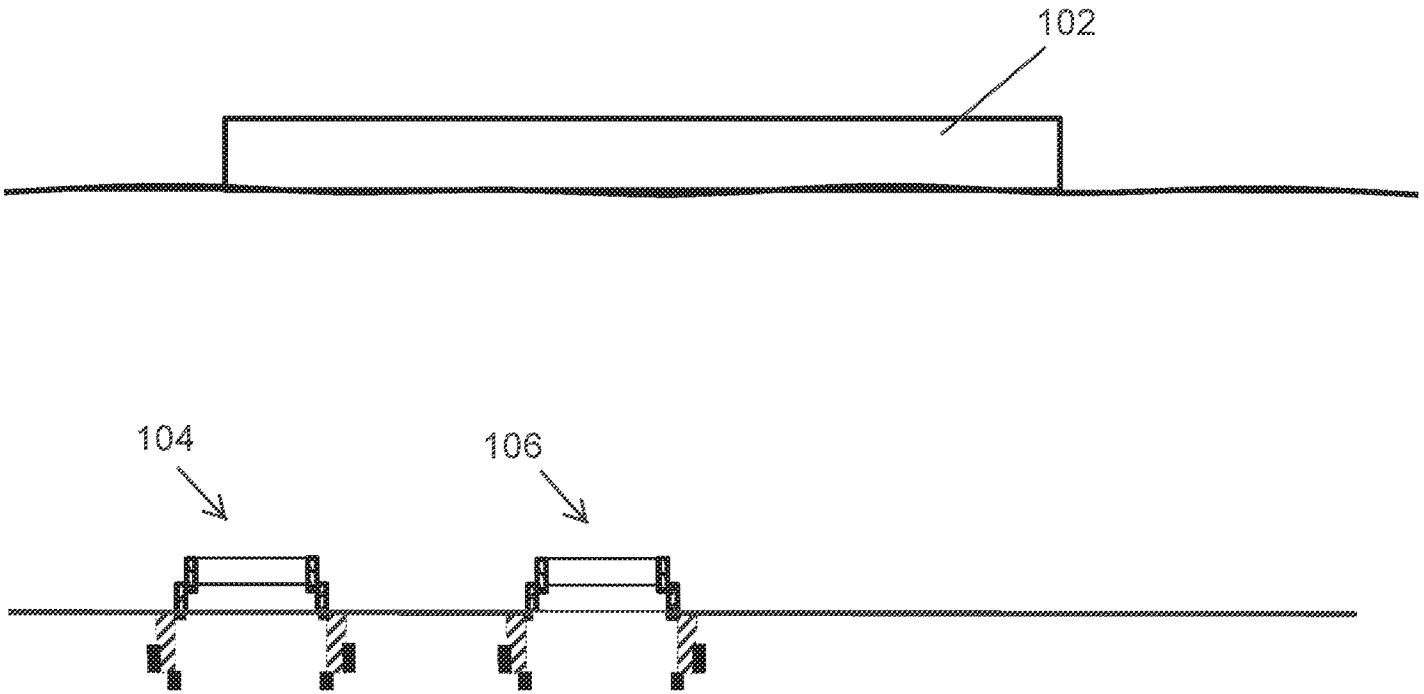
FIG. 3 illustrates the subsea wells of FIG. 1 prior to drilling sections of the subsea wells below the surface casings and casing the sections with intermediate casings according to an example embodiment.

Referring now to FIGS. 1-3, FIG. 3 illustrates the subsea wells 104, 106 of FIG. 1 prior to drilling sections of the subsea wells to a target depth below the surface casings 204 and casing the sections with intermediate casings 206 according to an example embodiment. The MCD 224 of the subsea well 104 is attached to the surface casing 204 of the subsea well 104 prior to drilling lower sections of the subsea well 104 to a target depth below the surface casing 204. The MCD 224 of the subsea well 106 is also attached to the surface casing 204 of the subsea well 106 prior to drilling lower sections of the subsea well 106 to a target depth below the surface casing 204.

Referring now to FIGS. 1-4, FIG. 4 illustrates the subsea wells 104, 106 of FIG. 1 prior to drilling lower sections of the subsea wells 104, 106 to a target depth below the intermediate casings 206 and setting production casings 208 or additional intermediate casings in the lower sections according to an example embodiment. After the respective MCD 224 is attached to the high pressure wellhead 222 of each subsea well 104, 106 and positioned at the seafloor, a lower section of each subsea well 104, 106 is drilled through the respective MCD 224 and set with an intermediate casing 206. To illustrate, the lower section of each subsea well 104, 106 that is set with the intermediate casing 206 may be drilled up to a target depth through the respective MCD 224 for receiving the intermediate casing 206. The intermediate casing 206 of each subsea well 104, 106 may extend down from the seafloor through the conductor casing 202 and the surface casing 204 of the respective subsea well 104, 106. The section of each subsea well 104, 106 corresponding to the surface casing 204 is drilled from the offshore drilling structure 102. The section of the subsea well 104 that is set with the respective intermediate casing 206 may be drilled first from the offshore drilling structure 102 followed by drilling, from the offshore drilling structure 102, of the section of the subsea well 106 that is then set with the respective intermediate casing 206.

The mud used in drilling the section of the subsea well 104 that is set with the intermediate casing 206 may be used to drill the corresponding section of the subsea well 106 that is set with the intermediate casing 206. To illustrate, the section of the subsea well 104 that is set with the intermediate casing 206 of the subsea well 104 may be drilled and set with the intermediate casing 206 of the subsea well 104 before drilling and casing the corresponding section of the subsea well 106 that is set with the intermediate casing 206 of the subsea well 106, which is drilled before further lower section(s) of the subsea well 104 are drilled. The intermediate casing 206 of each subsea well 104, 106 is cemented before drilling further lower sections of the subsea wells 104, 106. For example, cement 216 may be formed around the intermediate casing 206 of each subsea well 104, 106 between the intermediate casing 206 and earth formation 214 by pumping down cement from the offshore drilling structure 102 or from another offshore structure known to those of ordinary skill in the art.

In some example embodiments, another one or more intermediate casings are set in respective one or more sections drilled in each subsea well 104, 106 to a target depth below the intermediate casing 206. For example, an additional intermediate casing of the subsea well 104 is set in a corresponding additional section drilled in the subsea well 104 and an additional intermediate casing of the subsea well 106 is set in a corresponding additional section drilled in the subsea well 106 before a lower section below the additional intermediate casing of the subsea wells 104, 106 is drilled and set with an additional intermediate casing or a production casing. Mud used in drilling an additional section in the subsea well 104 that is set with an additional intermediate casing can be used in drilling a corresponding additional section in the subsea well 106 that is set with an additional intermediate casing.

In some example embodiments, after setting the intermediate casing 206 in the corresponding section of each subsea well 104, 106 as described above, a lower section of each subsea well 104, 106 is drilled and set with the respective production casing 208. Alternatively, a lower section of each subsea well 104, 106 is drilled and set with a production casing 208 after setting additional one or more intermediate casings in the corresponding one or more sections of each subsea well 104, 106 that are drilled below the corresponding intermediate casing 206.

The section of subsea well 104, 106 that is set with the production casing 208 may be drilled up to a target depth for receiving the production casing 208. The production casing 208 of each subsea well 104, 106 extends down from the seafloor through the conductor casing 202, the surface casing 204 and the intermediate casing 206, and any other additional intermediate casings that are below the intermediate casing 206. To illustrate, the section of subsea well 104 that is set with the production casing 208 may be drilled through the MCD 224 of the subsea well 104 and set with the respective production casing 208 and may be followed by drilling through the MCD 224 of the subsea well 106 the section of subsea well 106 that is set with the production casing 208 of the subsea well 106 and set with the respective production casing 208.

As more clearly shown in FIGS. 1 and 2, the production casing 208 of each subsea well 104, 106 is cemented. For example, cement 218 may be formed around the production casing 208 of each subsea well 104, 106 between the production casing 208 and the earth formation 214 by pumping down cement from the offshore drilling structure 102 or from another offshore structure known to those of ordinary skill in the art.

In some example embodiments, an optional respective production liner 210 may be set in a corresponding section of each subsea well 104, 106 drilled to below the respective production casing 208 of each subsea well 104, 106. Cement 220 may be formed around the production liner 210 between the production liner 210 and the earth formation 214 by pumping down cement using methods known to those of ordinary skill in the art.

The MCD 224 installed on the high pressure wellhead 222 of each subsea well 1024, 106 is much lighter than a subsea BOP and generally contains all of the on board power necessary to function. By using two or more MCDs at the seafloor, batch offshore drilling operations may be performed at a much lower cost, complexity, and risks than any batch drilling operations that may use subsea BOPs. Use of multiple MCDs allows continued batch drilling operations after the high pressure wellhead is attached to subsea wells.

Figure 4:
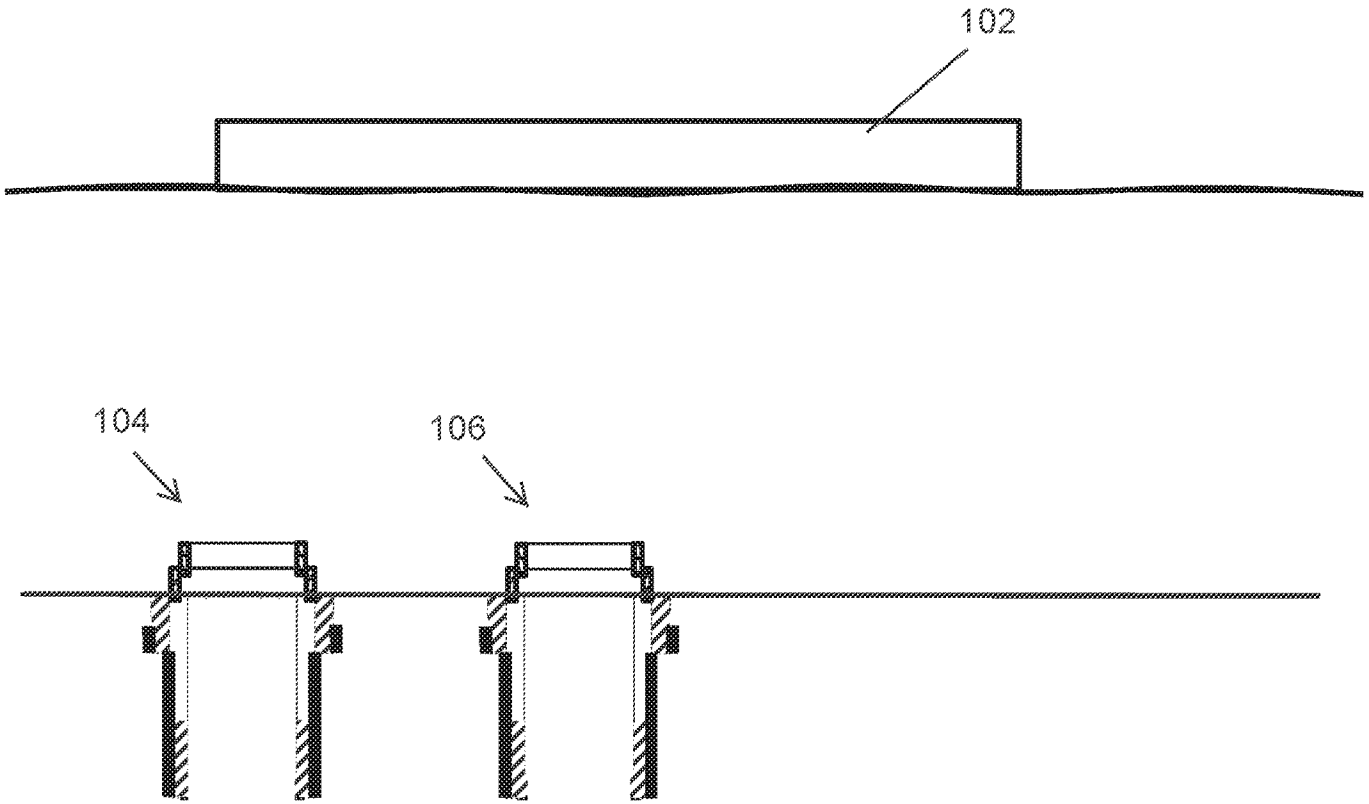
FIG. 4 illustrates the subsea wells of FIG. 1 prior to drilling lower sections of the subsea wells below the intermediate casings and casing the lower sections with production casings or additional intermediate casings according to an example embodiment.

Although two subsea wells 104, 106 are shown in FIGS. 1, 3, and 4, in some embodiments, batch drilling of more than two subsea wells may be performed from the same offshore drilling structure 102. For example, corresponding sections of three or more subsea wells with a respective individual MCD may be drilled and set with appropriate casings before the lower sections of the three or more subsea wells are drilled to further below. The drilling of the three or more subsea wells may be performed from the same offshore drilling structure 102 or another similar structure as may be contemplated by those of ordinary skill in the art with the benefit of this disclosure. In some example embodiments, the subsea wells 104, 106 may be part of a template of subsea wells that includes two or more subsea wells. Although the high pressure wellhead 222 of each of the subsea wells are described as being attached to the surface casing 204, in some alternative embodiments, the high pressure wellhead 222 may be attached to another structure without departing from the scope of this disclosure.

Figure 5:
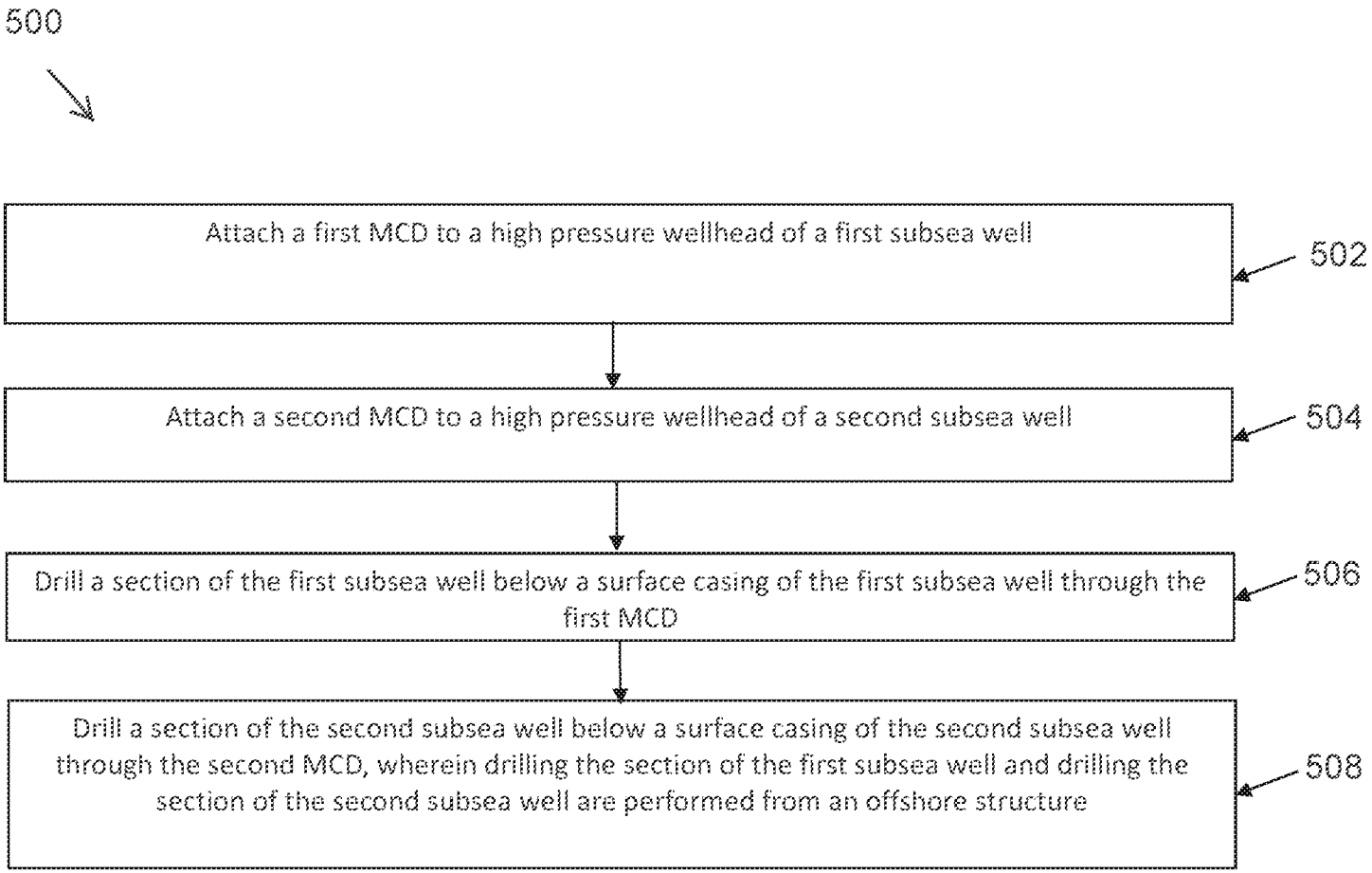
FIG. 5 illustrates a flowchart of a method of offshore batch drilling according to an example embodiment.

FIG. 5 illustrates a flowchart of a method 500 of offshore batch drilling according to an example embodiment. Referring to FIGS. 1, 2, and 5, the method 500 may include attaching a first MCD to a high pressure wellhead of a first subsea well at step 502. For example, the MCD 224 of the subsea well 104 may be attached to the high pressure wellhead 222 of the subsea well 104. At step 504, the method 500 includes attaching a second MCD to a high pressure wellhead of a second subsea well. For example, the MCD 224 of the subsea well 106 may be attached to the high pressure wellhead 222 of the subsea well 106.

At step 506, the method 500 includes drilling a section of the first subsea well to below a surface casing of the first subsea well through the first MCD. To illustrate, a section of the subsea well 104 that is set with the intermediate casing 206 may be drilled to below the surface casing 204 of the subsea well 104. The section of the subsea well 104 that is set with the intermediate casing 206 may be drilled through the MCD 224 of the subsea well 104.

At step 508, the method 500 includes drilling a section of the second subsea well below a surface casing of the second subsea well through the second MCD. To illustrate, a section of the subsea well 106 that is set with the intermediate casing 206 may be drilled to below the surface casing 204 of the subsea well 106. The section of the subsea well 106 that is set with the intermediate casing 206 may be drilled through the MCD 224 of the subsea well 106. The section of the first subsea well and the section of the second subsea well may be performed from an offshore structure such as the offshore drilling structure 102.

In some example embodiments, the method 500 may include casing the section of the first subsea well drilled at step 506 with a first intermediate casing. For example, the section of subsea well 104 that is drilled to below the surface casing 204 may be set with the intermediate casing 206. The method 500 may also include casing the section of the second subsea well with a second intermediate casing. For example, the section of subsea well 106 that is drilled to below the surface casing 204 may be set with the intermediate casing 206.

In some example embodiments, the method 500 may include, after drilling the section of the first subsea well to below the surface casing of the first subsea well and after drilling the section of the second subsea well to below the surface casing of the second subsea well, drilling a lower section of the first subsea well from the offshore structure through the first MCD. The lower section of the first subsea well reaches below the first intermediate casing. To illustrate, the section of the subsea well 104 that is set with the production casing 208 may be drilled through the MCD 224 (i.e., through the opening of the MCD 224) of the subsea well 104 after the section of the subsea well 104 that is set with the intermediate casing 206 and after the section of the subsea well 106 that is set with the intermediate casing 206 are drilled. Thus, the same mud may be used to drill the section of the subsea well 104 and the section of the subsea well 106 that are set with the respective intermediate casing 206.

In some example embodiments, the method 500 includes casing the lower section of the first subsea well 104 with the production casing 208. Alternatively, the lower section of the first subsea well 104 may be set with another intermediate casing.

In some example embodiments, the method 500 may include, after drilling the section of the first subsea well to below the surface casing of the first subsea well and after drilling the section of the second subsea well to below the surface casing of the second subsea well, drilling a lower section of the second subsea well from the offshore structure through the second MCD 104. The lower section of the second subsea well reaches below the second intermediate casing. To illustrate, the section of the subsea well 106 that is set with the production casing 208 may be drilled through the MCD 224 (i.e., through the opening of the MCD 224) of the subsea well 106 after the section of the subsea well 104 that is set with the intermediate casing 206 and after the section of the subsea well 106 that is set with the intermediate casing 206 are drilled. Thus, the same mud may be used to drill the section of the subsea well 104 and the section of the subsea well 106 that are set with the respective intermediate casing 206.

In some example embodiments, the method 500 includes moving the first MCD to a third subsea well. To illustrate, after the production casing 208 of the first subsea well 104 is set and cemented, the MCD 224 of the subsea well 104 may be detached from the surface casing 204 of the subsea well 104 and attached to the surface casing of another subsea well such as the subsea well 702 of FIG. 7. Referring to FIGS. 1, 2, 5, and 7, the MCD 224 of the subsea well 102 may be moved to the third subsea well 702 while drilling of the section of the subsea well 106 to be set with the production casing 208 is being performed. Alternatively, the MCD 224 of the subsea well 102 may be moved to the third subsea well 702 while casing of the section of the subsea well 106 with the production casing 208 is being performed.

In some example embodiments, the method 500 may include attaching, from the offshore structure, a third MCD to a high pressure wellhead of a third subsea well. To illustrate, instead of moving the MCD 224 from the subsea well 104 to the subsea well 702, an additional (i.e., a third) MCD 224 may be attached to the surface casing of the subsea well 702. For example, the intermediate casings of the subsea wells 104, 106, 702 may be set in the respective sections of the subsea wells 104, 106, 702 prior to drilling a lower section for the production casing of any of the subsea wells 104, 106, 702.

In some example embodiments, the method 500 may include additional steps or one or more steps may be omitted or performed in a different order than described without departing from the scope of this disclosure.

Figure 6:
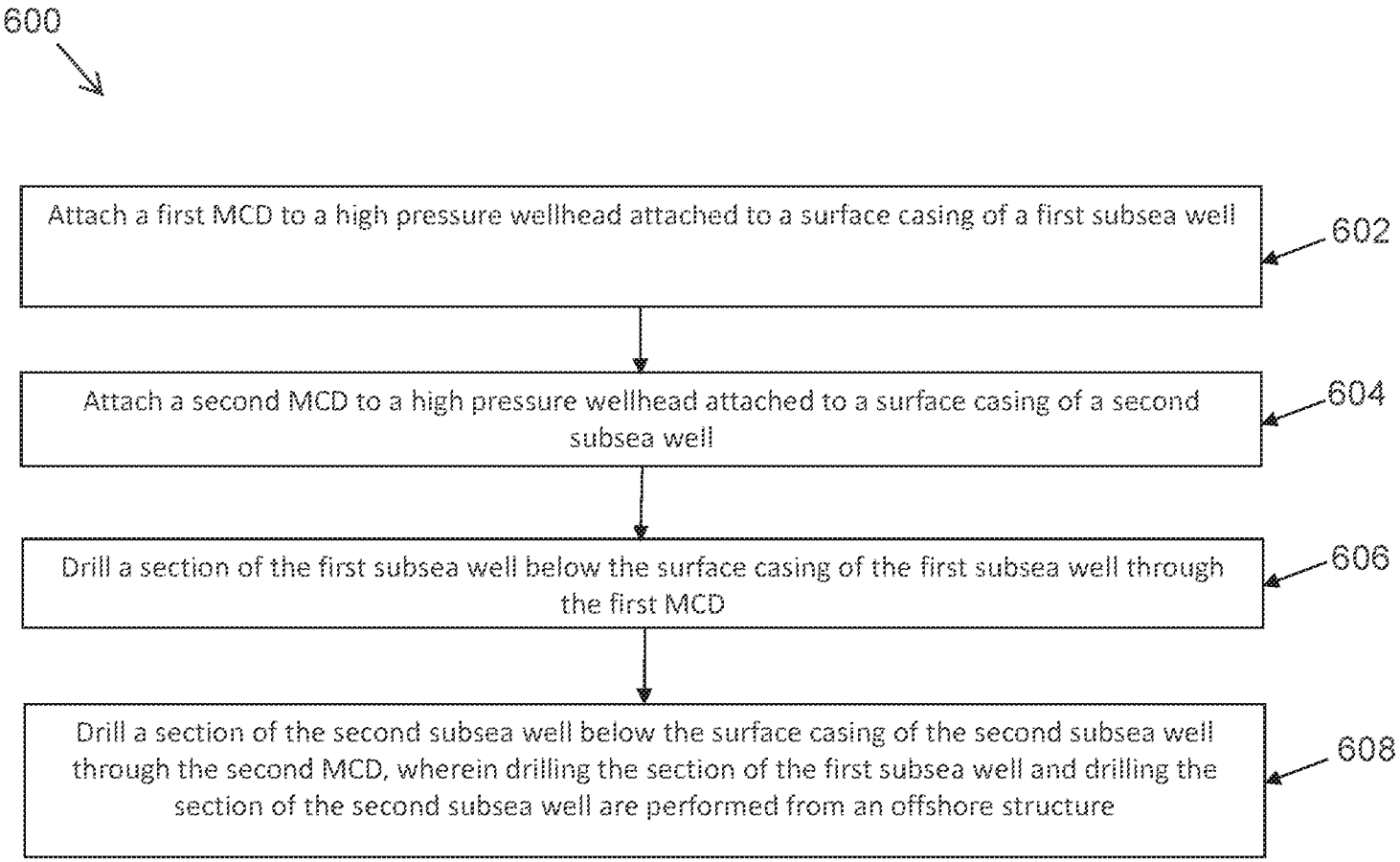
FIG. 6 illustrates a flowchart of a method of offshore batch drilling according to another example embodiment.

FIG. 6 illustrates a flowchart of a method 600 of offshore batch drilling according to another example embodiment. Referring to FIGS. 1, 2, and 6, the method 600 may include attaching a first MCD to a high pressure wellhead attached to a surface casing of a first subsea well, at step 602. For example, the MCD 224 of the subsea well 104 may be attached to the high pressure wellhead 222 attached to the surface casing 204 of the subsea well 104. At step 604, the method 600 may include attaching a second MCD to a high pressure wellhead attached to a surface casing of a second subsea well. For example, the MCD 224 of the subsea well 106 may be attached to the high pressure wellhead 222 attached to the surface casing 204 of the subsea well 106.

At step 606, the method 600 includes drilling a section of the first subsea well to below the surface casing of the first subsea well through the first MCD. To illustrate, a section of the subsea well 104 that is set with the intermediate casing 206 may be drilled to below the surface casing 204 of the subsea well 104. The section of the subsea well 104 that is set with the intermediate casing 206 may be drilled through the MCD 224 of the subsea well 104.

At step 608, the method 600 includes drilling a section of the second subsea well below a surface casing of the second subsea well through the second MCD. To illustrate, a section of the subsea well 106 that is set with the intermediate casing 206 may be drilled to below the surface casing 204 of the subsea well 106. The section of the subsea well 106 that is set with the intermediate casing 206 may be drilled through the MCD 224 of the subsea well 106. The section of the first subsea well and the section of the second subsea well may be performed from an offshore structure such as the offshore drilling structure 102.

In some example embodiments, the method 600 may include drilling a lower section of the first subsea well from the offshore structure through the first MCD, where the lower section of the first subsea well reaches below the section of the first subsea well drilled to below the surface casing of the first subsea well. For example, a section of the subsea well 104 may be drilled through the MCD 224 (i.e., through opening of the MCD 224) of the subsea well 104 to a target depth that is below the intermediate casing 206 and set with the production casing 208. The method 600 may also include drilling a lower section of the second subsea well from the offshore structure through the second MCD, where the lower section of the second subsea well reaches below the section of the second subsea well drilled to below the surface casing of the second subsea well. For example, a section of the subsea well 106 may be drilled through the MCD 224 (i.e., through opening of the MCD 224) of the subsea well 104 to a target depth that is below the intermediate casing 206 and set with the production casing 208. As explained above, the sections of the subsea wells 104, 106 to be set with the production casing 208 are drilled after the sections of the subsea wells 104, 106 to be set with the intermediate casing 208. Alternatively, subsequent intermediate casings may be set in sections of the drilled to below the subsea wells 104, 106 that are drilled to below the intermediate casing 206 of the subsea wells 104, 106.

In some example embodiments, the method 600 may include drilling a second lower section of the first subsea well from the offshore structure through the first MCD, where the second lower section of the first subsea well reaches below the lower section of the first subsea well. The method 600 may also include drilling a second lower section of the second subsea well from the offshore structure through the second MCD, where the second lower section of the second subsea well reaches below the lower section of the second subsea well. Drilling the second lower section of the first subsea well and drilling the second lower section of the second subsea well are performed after drilling the lower section of the first subsea well and after drilling the lower section of the second subsea well. To illustrate, the lower section of each subsea well 104, 106 may be set with a second intermediate casing below the intermediate casing 206, and the second lower section of each subsea well 104, 106 may be set with the production casing 208.

In some example embodiments, the method 600 may include setting the section of the subsea well 104, 106 with the respective intermediate casing 206 before drilling the lower section of the subsea well 104, 106 that is set with the respective production casing 206 or with another respective intermediate casing.

In some example embodiments, the method 600 may include attaching a third MCD to a high pressure wellhead attached to a surface casing of a third subsea well. To illustrate, instead of moving the MCD 224 from the subsea well 104 to the subsea well 702 as described below with respect to FIGS. 7 and 8, an additional (i.e., a third) MCD 224 may be attached to the surface casing of the subsea well 702. For example, a section of the subsea well 702 may be drilled to below the surface casing of the subsea well 702 through a third MCD 104 (i.e., through opening in the MCD). The section of the subsea well 702 may be drilled before drilling a lower section of the subsea well 104, where the lower section of the subsea well 104 reaches below the section of the subsea well 104 drilled to below the surface casing 204 of the subsea well 104.

In some example embodiments, the method 600 may include additional steps or one or more steps may be omitted or performed in a different order than described without departing from the scope of this disclosure.

Figure 7:
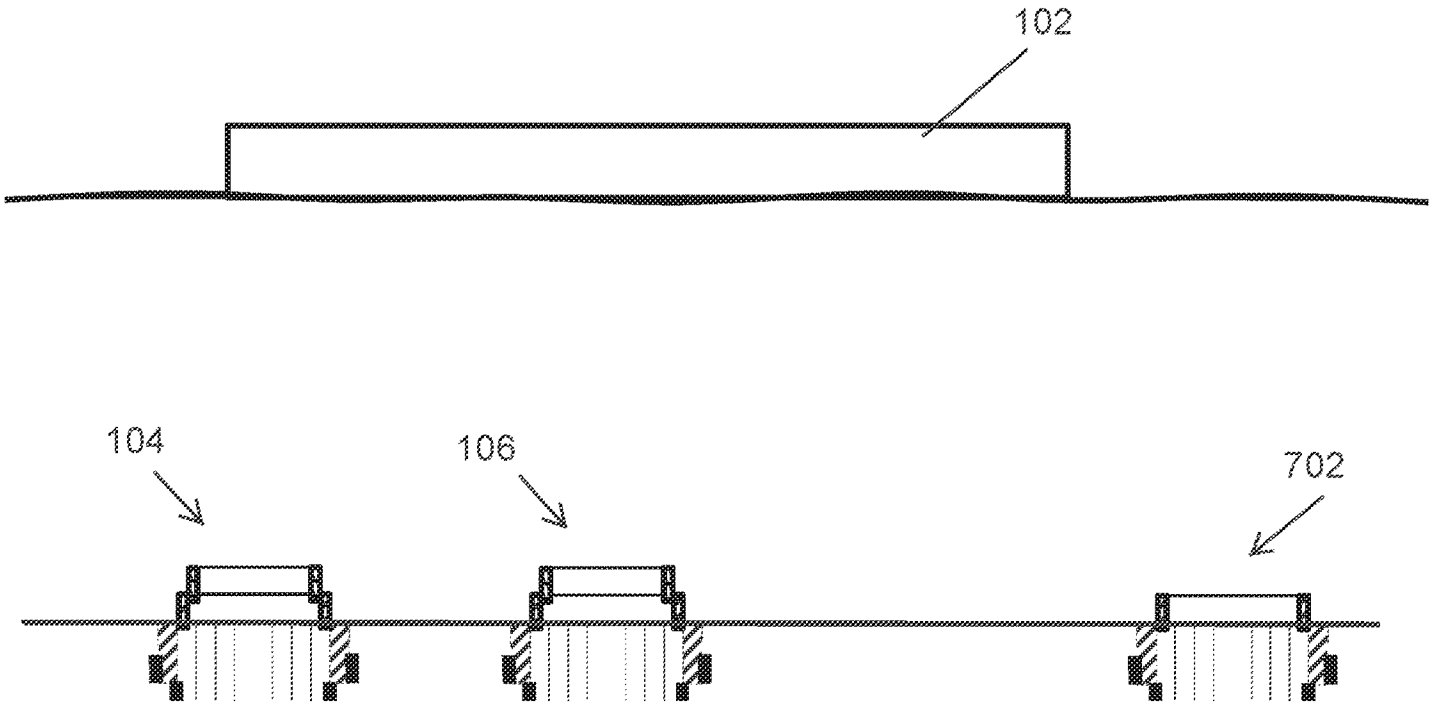
FIG. 7 illustrates an offshore batch drilling system including MCDs according to another example embodiment.
Figure 8:
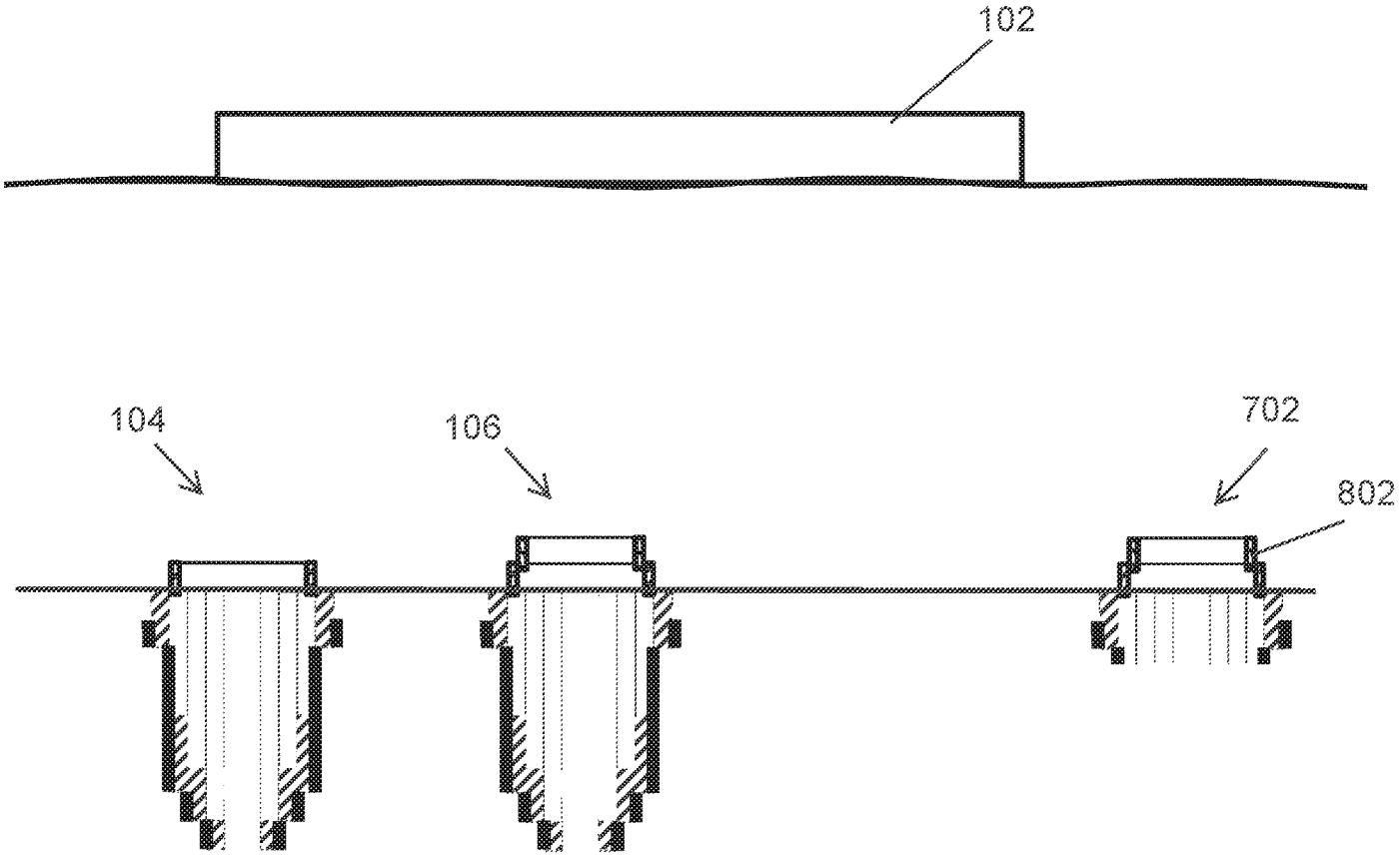
FIG. 8 illustrates the offshore batch drilling system of FIG. 7 after an MCD is moved from one subsea well to another subsea well according to another example embodiment.

FIG. 7 illustrates an offshore batch drilling system including MCDs according to another example embodiment. FIG. 8 illustrates the offshore batch drilling system of FIG. 7 after the MCD 224 is moved from the subsea well 104 to the subsea well 702 according to an example embodiment. Referring to FIGS. 1, 2, and 7, the subsea well 104,106, 702 may be drilled from the offshore drilling structure 102. The surface casing 204 of each subsea well 104,106, 702 is set and the respective high pressure wellhead 222 is attached to the surface casing 204. The respective MCD 224 is attached the surface casing 204 of the subsea well 104,106. However, an MCD is not attached to the high pressure wellhead of the subsea well 702 as more clearly illustrated in FIG. 7.

After production casing 208 is set in the subsea well 104, the MCD 224 of the subsea well 104 may be removed from the subsea well 104 and moved to subsea well 702 as shown in FIG. 8. For example, the MCD 224 of the subsea well 104 may be moved to the subsea well 702 while the section of the subsea well 106 to be set with the production casing 208 is being drilled. Alternatively, the MCD 224 of the subsea well 104 may be moved to the subsea well 702 while the production casing 208 is being set in the section of the subsea well 106.

Although some embodiments have been described herein in detail, the descriptions are by way of example. The features of the embodiments described herein are representative and, in alternative embodiments, certain features, elements, and/or steps may be added or omitted. Additionally, modifications to aspects of the embodiments described herein may be made by those skilled in the art without departing from the spirit and scope of the following claims, the scope of which are to be accorded the broadest interpretation so as to encompass modifications and equivalent structures. One of ordinary skill in the art will appreciate that in the development of any such actual embodiment, numerous implementation-specific decisions must be made to achieve the developers' specific goals, such as compliance with system-related constraints, which will vary from one implementation to another. Moreover, it will be appreciated that such a development effort might be complex and time-consuming, but would nevertheless be a routine undertaking for those of ordinary skill in the art having the benefit of this disclosure.

What is claimed is:

1. A method of offshore batch drilling, the method comprising:

attaching a first mudline closure device (MCD) to a high pressure wellhead of a first subsea well;

attaching a second MCD to a high pressure wellhead of a second subsea well;

drilling a section of the first subsea well to below a surface casing of the first subsea well through the first MCD, wherein a drilling riser is directly attached to the first MCD; and drilling a section of the second subsea well below a surface casing of the second subsea well through the second MCD before drilling a lower section of the first subsea well, wherein the lower section of the first subsea well reaches below the section of the first subsea well drilled to below the surface casing of the first subsea well, and wherein drilling the section of the first subsea well and drilling the section of the second subsea well are performed from an offshore structure without using a subsea blowout preventer (BOP).

2. The method of claim 1, further comprising:

casing the section of the first subsea well with a first intermediate casing; and casing the section of the second subsea well with a second intermediate casing.

3. The method of claim 2, further comprising, after drilling the section of the first subsea well to below the surface casing of the first subsea well and after drilling the section of the second subsea well to below the surface casing of the second subsea well, drilling the lower section of the first subsea well from the offshore structure through the first MCD, wherein the lower section of the first subsea well reaches below the first intermediate casing.

4. The method of claim 3, further comprising casing the lower section of the first subsea well with a production casing.

5. The method of claim 3, further comprising casing the lower section of the first subsea well with another intermediate casing.

6. The method of claim 3, further comprising, after drilling the section of the first subsea well to below the surface casing of the first subsea well and after drilling the section of the second subsea well to below the surface casing of the second subsea well, drilling a lower section of the second subsea well from the offshore structure through the second MCD, wherein the lower section of the second subsea well reaches below the second intermediate casing.

7. The method of claim 6, further comprising casing the lower section of the second well with a production casing.

8. The method of claim 6, further comprising casing the lower section of the second subsea well with another intermediate casing.

9. The method of claim 6, wherein drilling the lower section of the second subsea well is performed after drilling the lower section of the first subsea well.

10. The method of claim 6, further comprising moving the first MCD to a third subsea well.

11. The method of claim 10, wherein moving the first MCD to the third subsea well is performed while drilling the lower section of the second subsea well.

12. The method of claim 10, wherein moving the first MCD to the third subsea well is performed while casing the lower section of the second subsea well.

13. The method of claim 1, further comprising:

attaching, from the offshore structure, a third MCD to a high pressure wellhead of a third subsea well; and drilling a section of the third subsea well to below a surface casing of the third subsea well before drilling a lower section of the first subsea well, wherein the lower section of the first subsea well reaches below the section of the first subsea well reaching below the surface casing of the first subsea well.

14. A method of offshore batch drilling, the method comprising:

attaching a first mudline closure device (MCD) to a high pressure wellhead attached to a surface casing of a first subsea well;

attaching a second MCD to a high pressure wellhead attached to a surface casing of a second subsea well;

drilling a section of the first subsea well to below the surface casing of the first subsea well through the first MCD; and drilling a section of the second subsea well to below the surface casing of the second subsea well through the second MCD before drilling a lower section of the first subsea well, wherein the lower section of the first subsea well reaches below the section of the first subsea well drilled to below the surface casing of the first subsea well, and wherein drilling the section of the first subsea well and drilling the section of the second subsea well are performed from an offshore structure without using a subsea blowout preventer (BOP).

15. The method of claim 14, further comprising:

drilling the lower section of the first subsea well from the offshore structure through the first MCD, wherein the lower section of the first subsea well reaches below the section of the first subsea well drilled to below the surface casing of the first subsea well; and drilling a lower section of the second subsea well from the offshore structure through the second MCD, wherein the lower section of the second subsea well reaches below the section of the second subsea well drilled to below the surface casing of the second subsea well and wherein drilling the lower section of the first subsea well and drilling the lower section of the second subsea well are performed after drilling the section of the first subsea well and after drilling the section of the second subsea well.

16. The method of claim 15, further comprising:

drilling a second lower section of the first subsea well from the offshore structure through the first MCD, wherein the second lower section of the first subsea well reaches below the lower section of the first subsea well; and drilling a second lower section of the second subsea well from the offshore structure through the second MCD, wherein the second lower section of the second subsea well reaches below the lower section of the second subsea well and wherein drilling the second lower section of the first subsea well and drilling the second lower section of the second subsea well are performed after drilling the lower section of the first subsea well and after drilling the lower section of the second subsea well.

17. The method of claim 15, further comprising:

casing the section of the first subsea well with a first intermediate casing before drilling the lower section of the first subsea well; and casing the section of the second subsea well with a second intermediate casing before drilling the lower section of the second subsea well.

18. The method of claim 15, further comprising:

attaching a third MCD to a high pressure wellhead attached to a surface casing of a third subsea well; and drilling a section of the third subsea well to below the surface casing of the third subsea well through the third MCD, wherein the section of the third subsea well is drilled before drilling the lower section of the first subsea well from the offshore structure through the first MCD, wherein the lower section of the first subsea well reaches below the section of the first subsea well drilled to below the surface casing of the first subsea well.

19. An offshore batch drilling system, comprising:

an offshore structure;

a first mudline closure device (MCD) attached to a first high pressure wellhead of a first subsea well; and a second MCD attached to a second high pressure wellhead of a second subsea well, wherein the first subsea well and the second subsea well are drilled from the offshore structure without using a subsea blowout preventer (BOP), wherein a drilling riser is directly attached to the first MCD, wherein a section of the first subsea well that reaches below a surface casing of the first subsea well is drilled through the first MCD, wherein a section of the second subsea well that reaches below a surface casing of the second subsea well is drilled through the second MCD before drilling a lower section of the first subsea well, and wherein the lower section of the first subsea well reaches below the section of the first subsea well that reaches below the surface casing of the first subsea well.

20. The offshore batch drilling system of claim 19, wherein an intermediate casing of the first subsea well is set in the section of the first subsea well before a production casing of the first subsea well is set in the first subsea well and before a production casing of the second subsea well is set in the second subsea well and wherein an intermediate casing of the second subsea well is set in the section of the second subsea well before the production casing of the first subsea well is set in the first subsea well and before the production casing of the second subsea well is set in the second subsea well.

* * * * *